US008453766B2

(12) United States Patent
Graterol et al.

(10) Patent No.: US 8,453,766 B2
(45) Date of Patent: Jun. 4, 2013

(54) HYDROCARBON FORMATION CORE PROTECTION AND TRANSPORTATION APPARATUS

(75) Inventors: Leonardo Graterol, Carrizal (VE); Juan Ramos, San Antonio de Los Altos (VE); Ricardo Rojas, Highgate (AU); Richard Rengifo, Los Teques (VE); George Quercia, Eindhoven (NL)

(73) Assignee: Intevep, S.A., Caracas (VE)

( * ) Notice: Subject to any disclaimer, the term of this patent is extended or adjusted under 35 U.S.C. 154(b) by 0 days.

(21) Appl. No.: 13/208,928

(22) Filed: Aug. 12, 2011

(65) Prior Publication Data

US 2013/0037539 A1 Feb. 14, 2013

(51) Int. Cl.
*E21B 49/02* (2006.01)

(52) U.S. Cl.
USPC ..... 175/248; 175/245; 175/239; 175/249; 408/67; 408/204; 53/467; 220/23.83

(58) Field of Classification Search
USPC ..... 175/244, 245, 248, 249, 403, 236, 175/239, 232; 166/162; 408/67, 204, 80, 408/56, 703; 53/467
See application file for complete search history.

(56) References Cited

U.S. PATENT DOCUMENTS

| | | | | |
|---|---|---|---|---|
| 2,643,858 | A * | 6/1953 | Hardman | 175/46 |
| 2,654,572 | A * | 10/1953 | Arutunoff | 175/102 |
| 4,312,414 | A | 1/1982 | Park | |
| 4,502,553 | A * | 3/1985 | Park et al. | 175/59 |
| 5,277,252 | A | 1/1994 | Boe | |
| 7,234,547 | B2 | 6/2007 | Puymbroeck et al. | |
| 2008/0078585 | A1 * | 4/2008 | Melegari | 175/314 |

* cited by examiner

*Primary Examiner* — Yong-Suk (Philip) Ro
(74) *Attorney, Agent, or Firm* — Bachman & LaPointe, P.C.

(57) ABSTRACT

An apparatus for transporting core samples includes an outer tube having an open end and a cover removably mounted to the open end; a core tube slidable into and out of the outer tube when the cover is removed from the outer tube; and a supporting structure between the core tube and the outer tube. The supporting structure supports the core tube within the outer tube with the core tube spaced from contact with an inner wall of the outer tube.

20 Claims, 3 Drawing Sheets

HYDROCARBON FORMATION CORE PROTECTION AND TRANSPORTATION APPARATUS

BACKGROUND OF THE INVENTION

The invention relates to core samples from subterranean formations, potential hydrocarbon producing formations and the like, and more particularly, to an apparatus for protecting a core sample during transportation.

It is known to obtain cores from hydrocarbon and other types of formations in subterranean locations by driving a tube into the core and then bringing the tube to the surface where the sample of the material from within the tube can be analyzed for various different hydrocarbon exploration and producing information.

In the course of being brought from the subterranean location to the surface, the core is exposed to physical, chemical and environmental changes. These influences are not desirable as the core at surface conditions and after being exposed to other foreign substances begins to lose value as being indicative of formation conditions. This situation is worsened by the fact that the core must generally be transported at the surface to a facility for analysis.

The need exists for an apparatus for protecting a core from a subterranean formation during transportation.

The above concerns are particularly true in connection with evaluation of shale formations. Shale formations have become increasingly of interest in the hydrocarbon industry, and are important from a drilling point of view as more than 70% of the total column formations are represented by shale, and major operational problems take place in such formations. In addition, shale formations are typically under conditions which are even more subject to deterioration as a core is being transported on the surface, and therefore the need for an apparatus to address physical, chemical, and environmental changes as the core is being transported is even more pronounced with respect to shale formations.

SUMMARY OF THE INVENTION

In accordance with the present invention, an apparatus is provided which stores a core from a hydrocarbon or other formation at a subterranean location and protects that core from changes in conditions and exposure to other physical or chemical influences as the core is being transported to a facility for study of same.

According to the invention, an apparatus for preserving a formation core is provided which comprises an outer tube having an opening and a cover for the opening, the cover having a hermetic seal for producing a hermetically sealed environment within the outer tube, a core tube positioned within the outer tube for receiving a core to be preserved, the core tube being radially suspended within the outer tube to prevent contact of the core tube with the outer tube, and an inlet device for filling the outer tube with a core-friendly fluid after the core tube is in place within the outer tube. The core tube within the outer tube defines an annular space between these two tubes, and this annular space is for holding fluids introduced into the container through the inlet to aid in preserving the core.

The core tube can be suspended within the outer tube by a centralizing system, for example three or more spring loaded longitudinal plates which serve to keep the core tube spaced from the inner wall of the core tube and outer tube. In addition, an axial spring system can be provided, to absorb shocks to the overall apparatus in the course of transportation and prevent these shocks from being transmitted to the core within the core tube.

The core tube can advantageously be provided with one or more longitudinal slots or cutouts in the sidewall which lighten the device, and a downwardly curved edge which serves to ease the loading and removal process so that less potential damage is done to the core when it is being removed from the core tube.

Stabilizing structures may be provided on the outer tube for supporting the apparatus in a horizontal position. These stabilizing structures can advantageously position opposite to the handles on the outer tube.

The longitudinal plates are preferably spring mounted within the core tube, and the spring mounting can be conducted through adjustable spring loaded pistons so that the longitudinal plates can be positioned at a particular distance from each other to accommodate different-sized core samples.

The cover can advantageously have an adjustable axial spring mounted therein for providing axial spring-cushioned support for the core sample in an adjustable manner, to accommodate core samples of different length.

Other advantageous features of the present invention will appear below.

With the present invention, a core can be obtained and then protected during transportation from conditions which cause the sample to change. Thus, the sample, shale, for example preserved in the apparatus of the present invention is maintained in more useful condition and can provide better information for use in evaluating the subterranean formation from which it was obtained.

BRIEF DESCRIPTION OF THE DRAWINGS

A detailed description of preferred embodiments of the present invention follows, with reference to the attached drawings, wherein.

DETAILED DESCRIPTION

The invention relates to an apparatus for transporting a core sample and more specifically to an apparatus for transporting a core sample under controlled chemical, physical, and atmospheric conditions.

Figure 1:
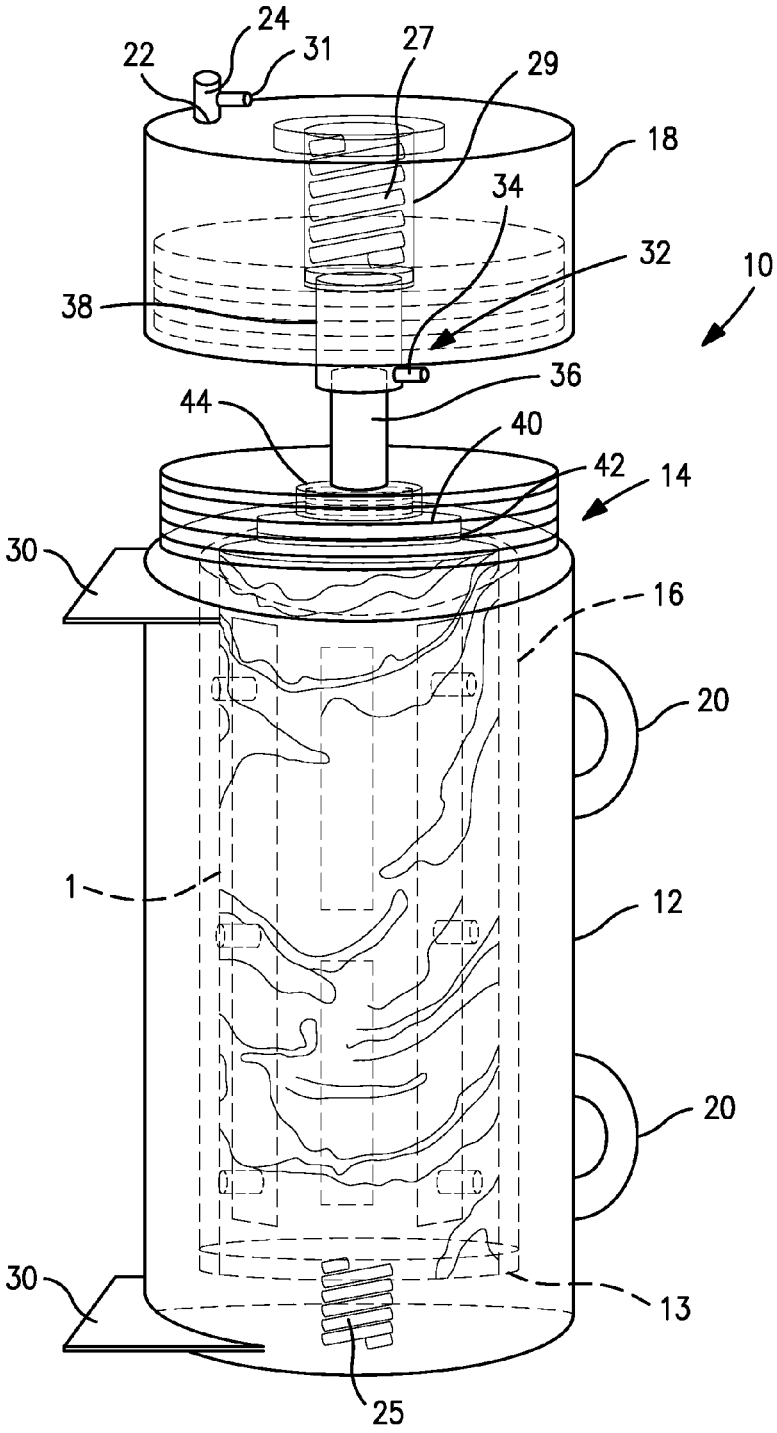
FIG. 1 schematically illustrates an apparatus according to the invention.

FIG. 1 schematically illustrates an apparatus 10 according to the invention, which has an outer tube 12 having an open end 14, a core tube 16 for holding a core sample 1, core tube 16 being sized to fit within outer tube 12 and which will be further described below, and a cover 18 for covering open end 14. For ease in transportation, outer tube 12 can be provided with one or more handles 20 which can be used for manually transporting apparatus 10 as desired.

Before continuing with further description of the apparatus, it should be understood that apparatus 10 could advantageously be used to transport a substantially cylindrical core sample 1 which is obtained from subterranean formations. Such core samples are frequently used in the oil industry to evaluate formations through which drilling is being done. While useful for any core sample, the apparatus of the invention is particularly well suited to core samples from subterranean shale formations. Core sample 1 is obtained using conventional techniques and is then transported through a well from the formation from which it is obtained to the surface. At the surface, core sample 1 is introduced into core tube 16 of apparatus 10 according to the invention, and apparatus 10 is then sealed for transport of the core sample as desired, and as will be further discussed below.

Figure 5:
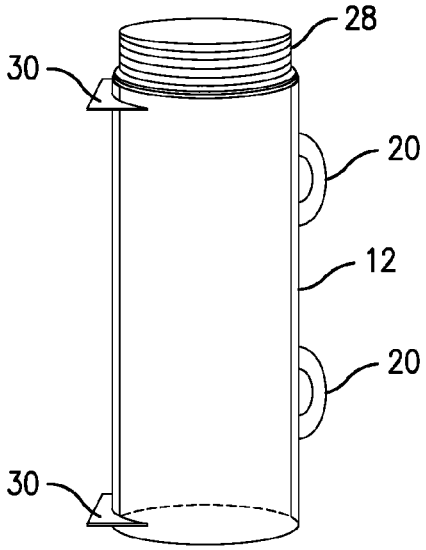
FIG. 5 further illustrates the outer tube of the apparatus of the present invention.

Cover 18 according to the invention can have a fluid inlet 22 and a fluid inlet plug 24 as will be further discussed below. Threads 26, 28 (FIGS. 5, 6) are provided at open end 14 and cover 18 for use in securing cover 18 over open end 14 of outer tube 12 as desired. In addition, fluid inlet 22 and fluid inlet plug 24 can also advantageously be secured using threads, for example with fluid inlet plug 24 having male threads and fluid inlet 22 having female threads.

The threaded connections between outer tube 12 and cover 18, and between fluid inlet 22 and fluid inlet plug 24 are advantageously structured to provide a sturdy and leak-proof seal so that the inner space of outer tube 12 can be hermetically sealed, for example at elevated pressures, without risk of leaks and without significant degradation of the environmental conditions of the sealed outer tube 12. To this end, O rings and various other seal members may be positioned between threads 26, 28 and also between fluid inlet 22 and fluid inlet plug 24, as desired.

Outer tube 12, cover 18, and fluid inlet plug 24 can advantageously be made of any suitable material which is both sturdy, strong enough to sustain high internal pressures and preferably sufficiently light that apparatus 10 can be manually carried from location to location. One particularly suitable material for use in manufacturing outer tube 12 and its related components is aluminum. Of course, other suitable materials can be used within the above-outlined confines, as could be surmised, given this guidance, by a person skilled in the art.

Figure 2:
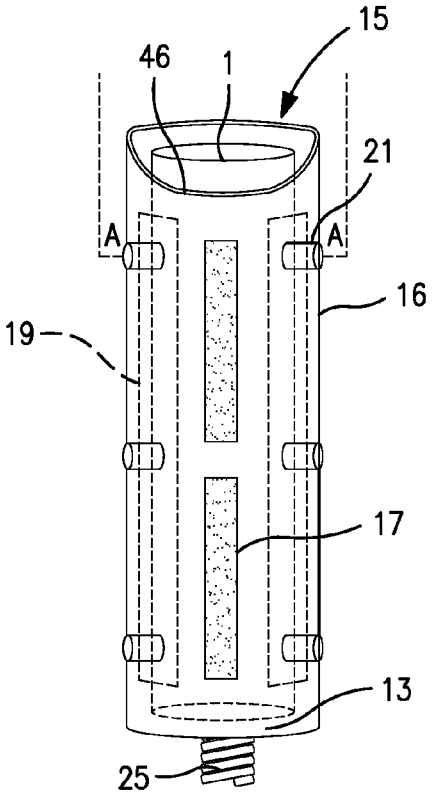
FIG. 2 illustrates a core tube of the apparatus of FIG. 1.
Figure 3:
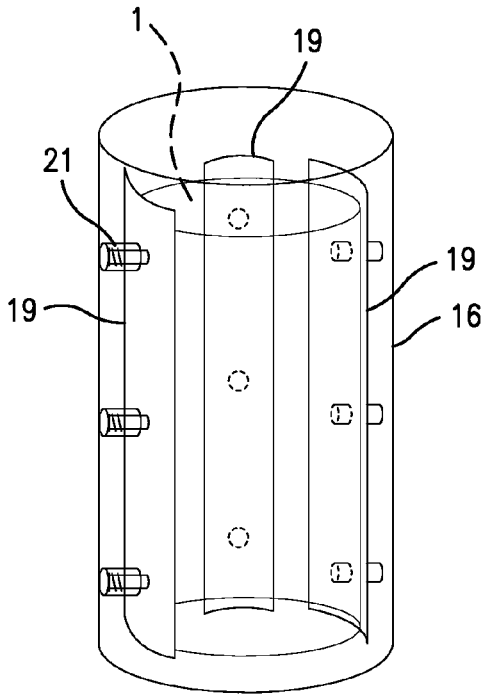
FIG. 3 further illustrates components of the core tube within the outer tube of the assembly of FIG. 1.
Figure 4:
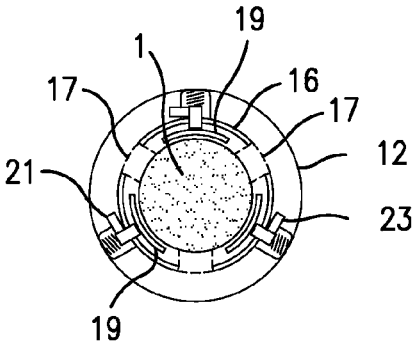
FIG. 4 is a top view of the core tube of the present invention holding a core.

FIGS. 2-4 further illustrate core tube 16 according to the invention. As shown, core tube 16 can advantageously be a tube smaller in diameter than outer tube 12, and preferably also somewhat shorter in length than outer tube 12. Tube 16 preferably has an open top 15 and a closed bottom 13, and bottom 13 can advantageously be made from a resilient material such as rubber or the like. As best seen in FIG. 4, core tube 16 can advantageously have a plurality of cutouts 17 in its circumference, and these cutouts advantageously reduce the weight of the structure, and also allow better access of fluids introduced into apparatus 10 to core 1 held within core tube 16.

It is desired that core 1 be held within core tube 16 in a way which minimizes contact of core 1 with the inner walls of core tube 16. To this end, a plurality of longitudinal plates 19 can be mounted to an inside surface of core tube 16, for example through spring loaded pistons 21 which can have securing member 23 such as an adjustable bolt or the like, for securing longitudinal plate 19 at a particular position with respect to an inner surface of core tube 16. In this way, longitudinal plates 19 can be adjusted to core samples 1 of various different diameter. It should be noted that while the embodiment of FIGS. 2-4 shows three longitudinal plates 19 for supporting core sample 1, it could be effective to utilize only two, or four or more of such longitudinal plates, and the arc length of each longitudinal plate could then be adjusted to provide suitable support for core sample 1 with minimum material used and with the smallest surface area contact between longitudinal plates 19 and core sample 1 for the purpose of minimizing any impact on core sample 1 and also for reducing weight of the overall apparatus. As seen in FIG. 4, spring loaded pistons 21 can also advantageously support core tube 16 within outer tube 12 against radial movement of core tube 16 within outer tube 12.

Referring to FIG. 1, core tube 16 and core sample 1 held within core tube 16 are also preferably held axially within outer tube 12 through spring structures 25, 27 at each end of the device as well. Spring 25 is shown in FIGS. 1 and 2 and this spring 25 provides cushioned support for the lower end or bottom 13 of core tube 16 within outer tube 12. Spring 27 is positioned at an upper end of apparatus 10 to provide cushioned support between an upper end of core sample 1 and the cover 18. This spring and support is also adjustable, as will be further discussed below.

FIG. 5 again illustrates outer tube 12 according to the invention, and between FIGS. 1 and 5, it can be seen that one or more stabilizing supports 30 can be provided, preferably radially extending from outer tube 12 and defining a flat surface upon which apparatus 10 can rest when apparatus 10 is laid on its side. Further, stabilizing support 30 can preferably be defined on an opposite side of outer tube 12 with respect to handles 20, such that when apparatus 10 is resting on stabilizing supports 30, handles 20 are in a substantially upward position for ease in lifting.

Figure 6:
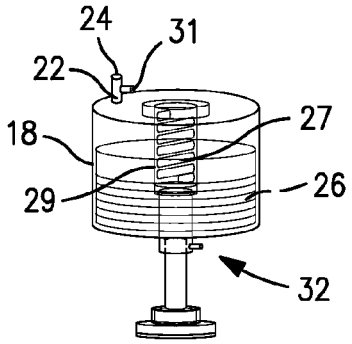
FIG. 6 further illustrates the cover of the apparatus of the invention.
Figure 7:
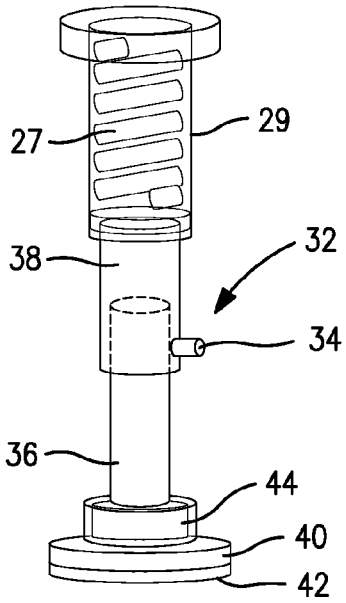
FIG. 7 further illustrates components of the cover of the apparatus in accordance with the present invention.

FIGS. 6 and 7 further illustrate the features of cover 18 in accordance with the present invention. Cover 18 can have internal or female threads 26 to engage with external or male threads 28 on outer tube 12. Threads 26, 28 can be seen from a consideration of FIGS. 5 and 6.

Cover 18 also preferably has a fluid inlet 22 the function of which will be discussed below, and a fluid inlet plug 24. Further, a pressure valve 31 can be incorporated into cover 18 for use in monitoring and/or releasing pressure within apparatus 10.

Cover 18 also supports spring 27 as mentioned previously, and spring 27 interacts with core sample 1 through an adjustable (e.g. telescoping) concentric tube assembly 32 having an adjustment bolt 34 for securing tube component 36 relative to tube component 38. At the core sample end of concentric tube assembly 32, a core sample support 40 can be provided, preferably having a rubberized contact surface 42, and support 40 can be rotatably mounted to lower component 36 through a bearing structure 44 which advantageously allows for free rotation of support 40 and rubber contact surface 42 relative to concentric tube assembly 32. This allows cover 18 to be threaded onto outer tube 12 without forcing frictional or rotational forces to be translated to core sample 1.

Spring 27 can be positioned in a sleeve 29 which slidably receives one end of concentric tube assembly 32, and sleeve 29 can be mounted to an inner surface of cover 18 as shown in FIGS. 1 and 6.

As can be seen from a consideration of FIG. 7, concentric tube assembly 32 is spring biased by spring 27 with respect to cover 18, and the axial position of support 40 can be adjusted by adjusting the position of lower component 36 relative to upper component 38 of concentric tube assembly 32.

In order to facilitate solid engagement with adjusting bolt 34, lower component 36 of concentric tube assembly 32 can be provided with a corrugated outer wall if desired.

Returning to FIG. 2, core tube 16 can advantageously be provided with a downwardly curved edge 46, preferably at an outer end thereof, this downwardly curved edge 46 advantageously helps in loading and unloading of core sample 1 into core tube 12 in accordance with the invention. Downwardly curved edge 46 can be downwardly curved in the shape of a half-circle, or other shapes, with the goal being to allow wider access for maneuvering core sample 1 into and out of core tube 16 as desired.

Core tube 16 can also be provided from a material following the same considerations as outlined with respect to outer tube 12 above. Flexibility of core tube 16 may be more important than it is with respect to outer tube 12, and it should also of course be appreciated that core tube 16 does not need to be hermetically sealed. Given this and the weight considerations of the entire apparatus, core tube 16 can suitably be provided from aluminum, by way of non-limiting example, and other suitable materials include but are not limited to titanium alloy, magnesium aluminum, fiber reinforced plastic (FRP) and the like. The suitable material is preferably relatively light to facilitate transportation.

In use, apparatus 10 advantageously allows for transportation of a core sample while protecting the core sample from shocks due to impacts which may occur during manual transportation. In addition, apparatus 10 according to the invention can be used to hermetically seal the core in an inner space which is filled with a suitable carrier fluid, such as for example diesel fuel or the like.

In order to obtain such transportation, the core sample is first obtained from formation at a down hole location utilizing well known coring techniques. These techniques include, but are not limited to, the driving of a tube into the formation and then removal of the tube, with enclosed core, from the well. Once the sample is obtained and brought to surface level through the well, the core sample can advantageously be positioned into a core tube according to the invention, and the core tube can then be suspended within an outer tube according to the invention. Cover 18 is then positioned over open end 14 of outer tube 12, with the core tube 16 and enclosed core sample 1 positioned therein. At this stage, prior to or during the loading of core sample 1 into core tube 16, the adjustable bolts 23 and spring loaded pistons 21 can be adjusted in core tube 16 to position longitudinal plates 19 at a desired spacing for properly supporting core sample 1 and further for properly positioning core tube 16 within outer tube 12. In addition, at this stage, the position of lower component 36 of concentric tube assembly 32 can be set relative to upper component 38 to provide for proper longitudinal support of core sample 1 as well. Once the configuration of apparatus 10 is properly set, and cover 18 is in place over open end 14 of outer tube 12, fluid inlet plug 24 can then be removed, or for that matter cover 18 can be installed over open end 14 with fluid inlet plug 24 already removed, such that a suitable core preserving fluid can be introduced into outer tube 12 through fluid inlet 22. This fluid can be diesel fuel, for example, or any other suitable fluid such as palm oil, biodiesel and any other oil based fluid formulated with low dynamic filtration characteristics, and which do not alter the wettability properties in the core sample.

Once apparatus 10 is completely filled with liquid, fluid inlet plug 24 can be positioned into fluid inlet 22 such that outer tube 12, cover 18 and fluid inlet plug 24 define an inner space containing the core sample within core tube 16, and this inner space is hermetically sealed. Furthermore, springs 25, 27 and spring loaded plates 19 prevent contact of core sample 1 with the inner wall of outer tube 12, and absorb shocks which may be exerted upon outer tube 12 before such shocks reach core tube 16 and the core sample supported therein. When filled, apparatus 10 can be manually transported as desired, for example using handles 20 as described above.

Once loaded apparatus 10 has reached its desired location, cover 18 can be removed and the core sample can be removed from core tube 16 such that the core can then be analyzed as desired in order to determine various characteristics of the formation from which the sample was taken.

Under some circumstances, it is desired to transport core sample 1 under elevated pressure or vacuum, and this can also be accomplished through pressurizing and/or drawing vacuum through fluid inlet 22. Pressure valve 31 can be used for monitoring pressure for this purpose, and also can be configured as a pressure release valve if needed.

It should be appreciated that the above description is made with respect to a specific preferred embodiment of the present invention. Various aspects of the invention could be modified by a person of ordinary skill in the art without departing from the spirit of the invention, and the scope of this invention is therefore not to be limited by the disclosed embodiment, but rather it is to be considered with respect to the scope of the claims appended to this application.

The invention claimed is:

1. An apparatus for transporting core samples, comprising:

an outer tube having an open end and a cover removably mounted to the open end;

a core tube slidable into and out of the open end of outer tube;

a supporting structure between the core tube and the outer tube, the supporting structure supporting the core tube within the outer tube with the core tube spaced from contact with an inner wall of the outer tube; and wherein the outer tube and cover define an inner space of the apparatus which is hermetically sealed as the cover is in position on the outer tube.

2. The apparatus of claim 1, wherein the outer tube has at least one handle for transporting the apparatus by hand.

3. The apparatus of claim 2, wherein the at least one handle comprises a gripping structure extending radially outwardly from an outer surface of the outer tube.

4. The apparatus of claim 1, wherein the core tube has at least one cutout.

5. The apparatus of claim 4, wherein the cutout passes through the sidewall of the core tube.

6. The apparatus of claim 1, wherein the core tube has a downwardly curved edge surface.

7. The apparatus of claim 1, wherein the supporting structure comprises at least three radially spaced longitudinal plates.

8. The apparatus of claim 7, wherein the at least three radially spaced longitudinal plates are spring mounted to an inner surface of the core tube.

9. The apparatus of claim 8, wherein the at least three radially spaced longitudinal plates are spring mounted to the core tube through adjustable spring loaded pistons.

10. The apparatus of claim 9, wherein the adjustable spring loaded pistons extend radially inwardly from the outer tube, and through the core tube to support the longitudinal plates spaced radially inwardly from the core tube.

11. The apparatus of claim 7, wherein the core tube is spaced radially inwardly from the outer tube, and wherein the longitudinal plates are spaced radially inwardly from the core tube.

12. The apparatus of claim 1, wherein the supporting structure further comprises at least one axially positioned spring between a core sample held in the core tube and at least one of a bottom of the outer tube and the cover.

13. The apparatus of claim 12, wherein the at least one axially positioned spring comprises a spring mounted in an adjustable concentric tube assembly.

14. The apparatus of claim 13, wherein the adjustable concentric tube assembly is mounted within the cover.

15. The apparatus of claim 14, further comprising a core sample support at a core sample end of the adjustable concentric tube assembly, wherein the core sample support is rotatable relative to the adjustable tube assembly.

16. The apparatus of claim 1, further comprising an oil inlet and an oil inlet plug for removably sealing the oil inlet, the oil inlet being positioned in one of the outer tube and the cover for introducing fluids and pressure into the outer tube.

17. The apparatus of claim 1, further comprising stabilizing supports extending radially outwardly from the outer tube.

18. The apparatus of claim 17, wherein the stabilizing supports define substantially flat surfaces for resting the apparatus in a horizontal position.

19. The apparatus of claim 18, wherein the outer tube has at least one handle for transporting the apparatus, the handle extending from one side of the outer tube, and wherein the stabilizing supports extend from an opposite side of the outer tube.

20. The apparatus of claim 1, wherein the outer tube has a closed end opposite to the open end, whereby the outer tube, closed end and cover define a sealed inner space.

* * * * *